United States Patent [19]

Melsheimer

[11] Patent Number: 4,522,099

[45] Date of Patent: Jun. 11, 1985

[54] TONE GENERATOR

[75] Inventor: Thomas Melsheimer, Longmont, Colo.

[73] Assignee: Adolph Coors Company, Golden, Colo.

[21] Appl. No.: 561,172

[22] Filed: Dec. 14, 1983

[51] Int. Cl.[3] ..... G10H 7/00

[52] U.S. Cl. ..... 84/1.01; 84/1.28; 84/DIG. 11

[58] Field of Search ..... 84/1.01, 1.19–1.28, 84/DIG. 11

[56] References Cited

U.S. PATENT DOCUMENTS 4,241,408 12/1980 Gross ..... 84/DIG. 11

*Primary Examiner*—Stanley J. Witkowski

[57] ABSTRACT

A tone generator as disclosed that produces a specified waveform by reading out values contained in one of a number of arrays stored in an EPROM. Variations of the desired waveform are stored in a number of these arrays. A microprocessor is used to select among the various arrays stored in the EPROM to compensate for distortion in subsequent processing of the waveform, as a function of amplitude and frequency. The rate at which the values are read from the selected array determines the frequency of the tone produced. Also disclosed are various means for processing the waveform suitable for use in audiometric testing.

7 Claims, 3 Drawing Figures

TONE GENERATOR

BACKGROUND OF THE INVENTION

The present invention relates to a tone generator wherein tones are produced by reading out values contained in one of a number of arrays stored in an EPROM. Each of these arrays contains a series of binary representations of the waveform to be generated; however, these values have been adjusted to compensate for distortion that may arise in subsequent processing of the tone, such as to account for the performance characteristics of subsequent amplifiers speakers, or headphones as a function of the amplitude and frequency of the tone. A microprocessor is used to select among the various arrays stored in the EPROM based on the amplitude and frequency of the desired tone.

The prior art contains a number of examples of waveform generators by reading out values stored in a memory, such as Niimi, U.S. Pat. No. RE. 31,004, "Electronic Musical Instrument Utilizing Data Processing System" at column 5, line 59 through column 6, line 10; and Tomisawa, U.S. Pat. No. 4,036,096 "Musical Tone Waveshape Generator", at column 1. In addition, various digital techniques have been used in the electronic music arts, specifically electronic organs for many years. The frequency of the tone produced by such devices is determined by the rate at which the waveform is read out of the memory.

All electrical or physical devices that generate, process, or use a tone inevitably result in some distortion of the tone. For example, all amplifiers and speakers have performance characteristics that vary both as a function of the amplitude and frequency of the tone being reproduced. In many applications this distortion is of little or no practical significance. However, in other fields, such as audiometric testing, this distortion is of vital concern and must be eliminated to the fullest extent possible. A wide variety of conventional manual calibration and equalization techniques have been employed in audiometric testing equipment to minimize such distortion. This approach has the disadvantage of adding substantially to the complexity, costs and weight of the audiometer.

SUMMARY OF THE INVENTION

Therefore, it is an object of this invention to provide a tone generator that can be preprogrammed to anticipate subsequent distortion in the tone due to an amplifier, other circuitry, or reproduction using a speaker, as a function of both the amplitude and frequency of the tone. In providing such compensation as the tone is generated, the present invention eliminates the necessity for subsequent costly and complex calibration or equalization circuitry.

It is another object of this invention to provide a comparatively inexpensive tone generator requiring a minimum of adjustment in calibration by the user.

It is still another object of this invention to provide, in the alternative, a tone generator capable of providing any of a diverse set of arbitrary waveforms simply by reprogramming the values stored in the various arrays of the memory.

DESCRIPTION OF THE INVENTION

Figure 1:
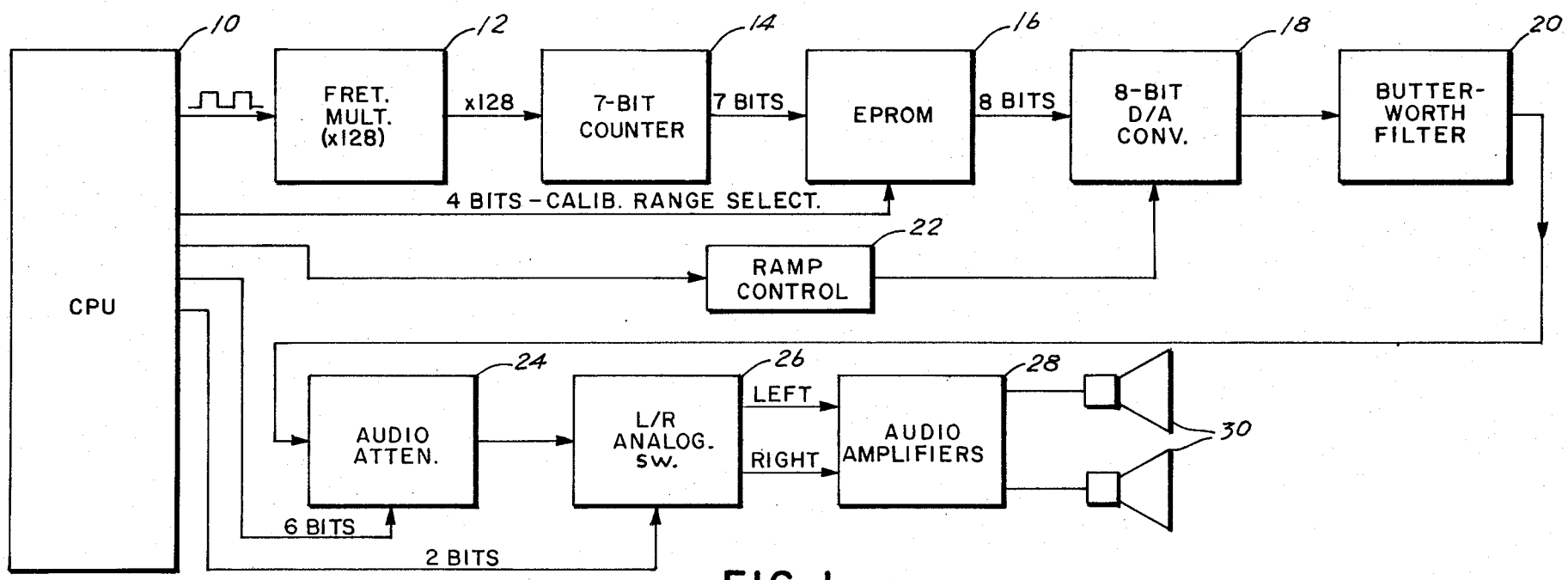
FIG. 1 is a block diagram of an embodiment of this invention.

One embodiment of the invention is shown in block diagram form in FIG. 1. In the preferred embodiment, the tone generator is controlled by a processor or CPU 10, such as the 6521 microprocessor manufactured by Mostek, among others. Communication between the processor and the remainder of the tone generator is facilitated by a conventional 6522 parallel communications port. The processor specifies the frequency of the desired tone to be generated by producing a train or series of electrical pulses of the desired frequency. The quartz clock that controls timing for the processor provides a sufficiently accurate reference for generation of this series of pulses by the processor. A frequency multiplier 12 is operatively connected to the processor so as to generate as its output a series of electrical pulses having a frequency equal to a predetermined multiple of the input frequency. Although any other integral multiplication factor could conceivably be used, practical concerns dictate use of a multiplication factor equal to an integral power of two, such as 32, 64, 128, 256, etc. In the preferred embodiment of the invention, this frequency multiplication factor is 128. For example, if a tone frequency of 1 KHz is desired, the processor will generate a series of pulses having a frequency of 1 KHz, and the frequency multiplier will generate as its output a series of electrical pulses having a frequency of 128 KHz.

The pulses produced by the frequency multiplier provide the input to a digital counter 14 that generates as its output a binary count of the input pulses generated by the frequency multiplier. The counter must have a predetermined number of binary digits as its output so that the number of pulses generated by the frequency multiplier in response to 1 pulse produced by the clock will cause the counter to increment through its entire range of output values exactly once. For example, in the preferred embodiment, a 7-bit counter is used, employing two National Semiconductor 74LS193 counters. The range of values for a 7-bit counter is equal to $2^7$, or 128. One pulse produced by the processor (or clock) causes the frequency multiplier to produce 128 pulses, which causes the counter to increment through its entire range of values (0 through 127) exactly once. Other combinations of these factors could be used equally well as long as the proper relationship between the size of the counter and the frequency multiplication factor is maintained. For example, a 6-bit counter would require a frequency multiplication factor of 64 ($2^6=64$), or an 8-bit counter would require a frequency multiplication factor of 256 ($2^8=256$).

A memory 16 is operatively connected in series with the counter. Virtually any type of random access memory can be used, although the preferred embodiment employs a 2K×8-bit erasable-programmable-read-only memory (Motorola 2716 EPROM). A 2K memory requires an 11-bit address ($2{,}048=2^{11}$). Given such an 11-bit address, the memory produces as its output the 8 bits of data previously stored in that address. One novel aspect of the present invention is that the address used by the EPROM is derived from two sources. In the preferred embodiment 7 bits of this address are derived from the counter. The remaining 4 bits are provided directly by the processor, and maybe referred to as the calibration selector bits. The EPROM in the present invention maybe conceptualized as a two dimensional table of values in which the row and column of any table entry is uniquely specified by the counter bits and the calibration selector bits, respectively. Alternatively, the EPROM can be viewed as a series of one-dimensional arrays in which any specific array can be uniquely addressed by the calibration range selector bits; and any particular element within the array can be uniquely addressed by the counter bits. In the preferred embodiment, each array stores binary values of the waveform to be generated, as sampled at 128 equally spaced points along one cycle of the waveform. Thus, for each pulse produced by the processor, the counter cycles through its entire range of 128 values, causing the 128 values of the waveform to be sequentially read out of the memory. The processor controls which array is read out of the memory by setting the appropriate calibration selector bits. Given four calibration selector bits in the preferred embodiment, the processor can select any one of 16 different arrays, each containing its own waveform. The waveform stored in each of these arrays are not necessarily related to one another. Depending on the values stored in these arrays, the processor could make use of the calibration selector bits to control a number of entirely arbitrarily and unrelated waveforms so as to simulate the tone qualify of different instruments.

However, one primary purpose of the present invention is to provide a means to compensate for subsequent distortion in processing and reproduction of the tone, as a function of the amplitude and frequency. When used in this configuration, the various arrays in the EPROM are used to store a family of waveforms, each of which have been modified or adjusted in some way to compensate for this distortion as a function of both amplitude and frequency of the tone to be produced. The processor controls both the frequency and amplitude of the tone, and so maybe programmed with an algorithm to set the calibration selector bits to pick the array in the EPROM that appropriately compensates for distortion produced by the remainder of the tone generator at that frequency and amplitude.

It should be obvious to one skilled in the art that virtually any size of memory can be used in the present invention, depending on the size of the counter and the number of calibration selector bits desired. In addition, for any given memory size, the number of address bits contributed by the counter and the calibration selector bits, respectively, may be allocated as desired by altering the multiplication factor of the frequency multiplier and the size of the counter. Further, although an 8-bit (16) EPROM as used in the preferred embodiment of the invention, a memory having any desired word-size can be used.

Figure 2:
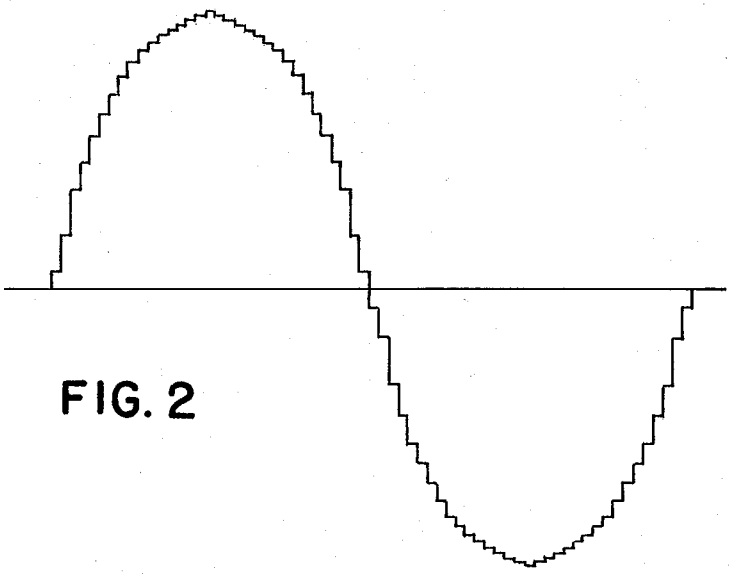
FIG. 2 is a waveform diagram illustrating an example of a waveform generated as the output of the digital-to-analog converter incorporated in the invention.

The binary waveform values read from the EPROM are then passed to a digital-to-analog converter 18, such as the 8-bit Analog Devices DAC0801. This digital-to-analog converter converts these digital values into an analog waveform as shown in FIG. 2. Each vertical step in the waveform shown in FIG. 2 results from one digital value read from the EPROM.

The signal produced by the digital-to-analog converter may be passed through a filter 20 to smooth the discontinuity shown in FIG. 2. For example, a conventional Butterworth filter could be used to smooth the waveform shown in FIG. 2 into a sine wave.

Figure 3:
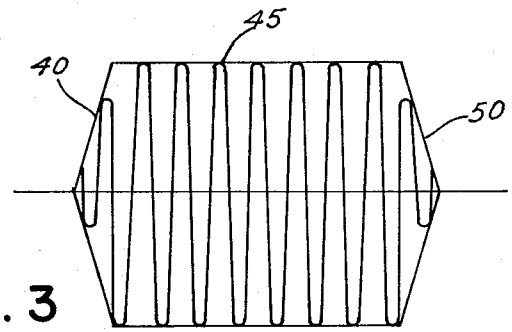
FIG. 3 is a waveform diagram illustrating an example of a tone generated as the output of the audio amplifiers that are included in the invention.

FIG. 3 shows one example of a tone that may be produced using the preferred embodiment of present invention for audiometric testing. The amplitude of the tone 45 is fixed by a programmable audio attenuator 24 (Analog Devices AD7110) that accepts as its input the filtered analog waveform produced by the digital-to-analog converter, and generates as its output the same waveform with an amplitude that has been divided by a factor specified by the processor. The ramps (40 and 50) as shown in the FIG. 3 may either be produced by means of the audio attenuator, or by a separate ramp control means 22, as indicated on FIG. 1. Many digital-to-analog converters, including the device used in the preferred embodiment of this invention, are current-controlled devices in which the amplitude of the output analog waveform may be controlled by varying the current supplied to the digital-to-analog converter by its power supply. As shown in FIG. 1, a ramp generator controlled by the processor may be used to regulate the flow of current to the digital-to-analog converter, resulting in an increasing ramp 40 or a decreasing ramp 50.

FIG. 1 also shows a left/right analog switch 26(Intersil H5043CPE) that can be controlled by the processor to direct the tone to either or both of parallel left and right audio channels for use in audiometric testing. Audio amplifiers (28) are used to provide sufficient power to the left and right audio channels to drive speakers or headphones 30.

I claim:

1. A tone generator comprising:

a clock generating a series of electrical pulses having the same frequency as the desired tone;

a frequency multiplier operatively connected to said clock, generating as its output a series of electrical pulses having a frequency equal to an integral multiple of the clock frequency;

a counter that is operatively connected to said frequency multiplier, generating as its output a binary count of the input pulses generated by the frequency multiplier; said counter having a predetermined number of binary digits such that the number of pulses generated by the frequency multiplier in response to one pulse produced by the clock will cause the counter to increment through its entire range of output values exactly once;

a memory comprising a plurality of arrays, each array comprising a series of elements in which have been stored binary values of the waveform of the tone to be generated, as sampled along one cycle of said waveform; the contents of each element within a given array of said memory being uniquely addressed by the binary count generated by the counter, and the specific array being uniquely addressed by a number of additional calibration selector bits that are set by external means; each array having a predetermined length equal to the multiplication factor of the frequency multiplier, so that the contents of the selected array are sequentially read out of the memory exactly once for each pulse generated by the clock;

a digital-to-analog converter that accepts as its input the digital values read out of the memory, and converts said digital values into an analog waveform.

2. The tone generator as defined in claim 1 further comprising:

a processor programmed to set the calibration selector bits of the memory based on the desired frequency and amplitude of the tone to be generated so as to select one array from the memory containing waveform values calculated to compensate for distortions that may arise in succeeding portions of the apparatus as a function of the frequency and amplitude of the desired tone.

3. The tone generator as defined in claim 1 further comprising:

a filter operatively connected in series with the output of the digital-to-analog converter, which smooths the waveform produced by said digital-to-analog converter so as to smooth any discontinuities that may result from abrupt jumps in successive values read from an array in the memory.

4. The tone generator of claim 2 further comprising:

a programmable attenuator operatively connected in series with the tone generator, that accepts as its input the waveform produced by the tone generator, and generates as its output the same waveform reduced in amplitude by an attenuation factor specified by the processor.

5. The tone generator of claim 2 further comprising:

a ramp controller in serial connection between the digital-to-analog converter and its power supply to regulate the flow of current through the digital-to-analog converter as specified by the processor and so providing means to vary the amplitude of the waveform produced by the digital-to-analog converter.

6. The tone generator as defined in claim 2 further comprising:

a switch operatively connected in series with the tone generator, capable of switching the tone generated into left or right audio channels under the control of the processor, for use in audiometric testing.

7. A tone generator comprising:

a clock generating a series of electrical pulses having the same frequency as the desired tone;

a frequency multiplier that accepts as its output the electrical pulses produced by the clock, and generates as its output a series of electrical pulses having a frequency 128 times the input frequency;

a 7-bit counter that accepts as its input the series of electrical pulses generated by the frequency multiplier and generates as its output a 7-bit binary count of the input pulses;

a memory consisting of a number of 8-bit words, arranged in 128-word arrays, each array storing binary representations of the waveform of a tone to be generated as sampled at 128 equally spaced points along one cycle of said waveform; the contents of each word within a given array of said memory being uniquely addressed by the 7-bit binary count generated by the counter, and the specific array being uniquely addressed by a number of additional calibration selector bits that are set by external means;

an 8-bit digital-to-analog converter that accepts as its input the digital values read out of the memory and converts said digital values into an analog waveform.

* * * * *